United States Patent [19]

Thrift

[11] 4,407,558

[45] Oct. 4, 1983

[54] ELECTRICAL CONNECTOR ASSEMBLIES FOR CAPACITIVE FLUID-GAUGING PROBES

[75] Inventor: Peter R. Thrift, Basingstoke, England

[73] Assignee: Smiths Industries Public Limited Company, London, England

[21] Appl. No.: 260,461

[22] Filed: May 4, 1981

[30] Foreign Application Priority Data

May 13, 1980 [GB] United Kingdom ..... 8015814

[51] Int. Cl.[3] ..... H01R 13/516; H01R 13/635

[52] U.S. Cl. ..... 339/121; 339/15; 339/74 R; 339/119 R; 339/186 R

[58] Field of Search ..... 339/74 R, 184 R, 184 M, 339/186 R, 186 M, 198 R, 198 S, 198 P, 198 G, 206 R, 206 P, 207, 208, 210 R, 210 M, 15, 16 R, 121, 119 R

[56] References Cited

U.S. PATENT DOCUMENTS 3,085,219 4/1963 Bass, Jr. ..... 339/15
3,287,031 11/1966 Simmons et al. ..... 339/186 R
3,594,696 7/1971 Witek, Jr. ..... 339/60 M
3,976,348 8/1976 Simmons ..... 339/74 R
4,227,762 10/1980 Scheiner ..... 339/186 M
4,238,140 12/1980 Cairns et al. ..... 39/186 M

*Primary Examiner*—Neil Abrams
*Attorney, Agent, or Firm*—Pollock, Vande Sande & Priddy

[57] ABSTRACT

A connector assembly for a capacitive fuel-gauging probe comprises a socket assembly, mounted on the probe, and plugs. The socket assembly has several sockets each of which has an elongate contact element. The inner surface of each socket has a number of axial rails and channels which engage with rails and channels formed on the outer surface of the housing of a cooperating plug. The cooperating surfaces of the plugs and sockets differ one from the other so that only the correct plug can be inserted in the correct socket. The contact element of each plug is in the form of a resilient loop, the upper portion of which has a projection that locks with an aperture in the socket contact element. Pulling the plug housing out of the socket moves the projection out of the aperture so that the plug can be withdrawn.

9 Claims, 4 Drawing Figures

ELECTRICAL CONNECTOR ASSEMBLIES FOR CAPACITIVE FLUID-GAUGING PROBES

BACKGROUND OF THE INVENTION

This invention relates to electrical connector assemblies, and more particularly to plug and socket assemblies.

In many applications, such as in capacitive fuel-gauging systems, it is necessary to make several connections to a piece of electrical apparatus or equipment (such as, for example, a fuel-gauging probe) with a number of different electrical cables. In order to ensure that the correct cable is connected to the correct element on the electrical equipment, the cables and equipment are provided with cooperating connector elements which can only be engaged with the correct element on the other part. This has been done in the past by means of the bayonet type of connector in which the contact element on one part is in the form of one or more axial pins within a cylindrical outer sleeve; the contact element on the other part being in the form of mating female sockets similarly provided within an outer sleeve. The outer sleeve on one part is provided with a number of radially-projecting pegs that engage with cooperating recesses on the inner surface of the other sleeve. The two parts are locked by pushing together and rotating so that strain on the cable acts on the pegs and will not pull the two parts away from one another.

The above connectors have the disadvantage that they are relatively expensive to make and that, because they require to be locked by relative rotation, they can be difficult to use in inaccessible locations.

BRIEF SUMMARY OF THE INVENTION

It is an object of the present invention to provide a connector assembly that substantially overcomes the above-mentioned disadvantages.

According to one aspect of the present invention there is provided an electrical plug and socket connector assembly for a capacitive fluid-gauging probe, the assembly including a socket member having a first elongate electrical contact element extending axially of the socket member, and a plug member having an outer housing containing a second contact element that engages with the first contact element, wherein said assembly includes a plurality of socket members and a plurality of plug members, the housings of said plug and socket members being provided with a configuration of axially extending surface formations which differ from one another on at least some of the plug and socket members so as thereby to prevent a said plug member being inserted in one of said socket members.

In this way, it is ensured that the correct plug is inserted in the correct socket.

The first and second contact elements may have cooperating locking means, the second contact element being mounted for limited displacement along its housing, and the housing having an inwardly directed surface formation that is arranged to engage the said second contact element on movement of the housing away from its respective socket member such as to urge the locking means out of engagement with one another and thereby permit withdrawal of said plug member from said socket member.

By providing locking means that are actuated by axial displacement of the plug within the socket, the need to cause relative rotation of the plug and socket is obviated, thereby facilitating mating of the two parts.

A connector assembly for a capacitive fuel-gauging probe will now be described, by way of example, with reference to the accompanying drawings.

DETAILED DESCRIPTION

Figure 1:
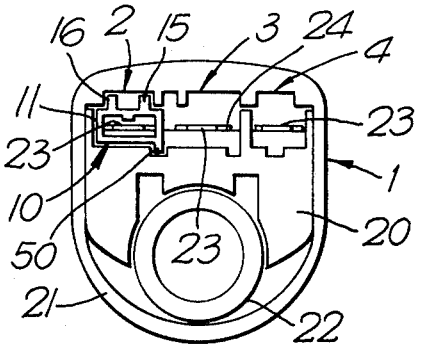
FIG. 1 illustrates schematically a cross-sectional view across the assembly from one end.
Figure 2:
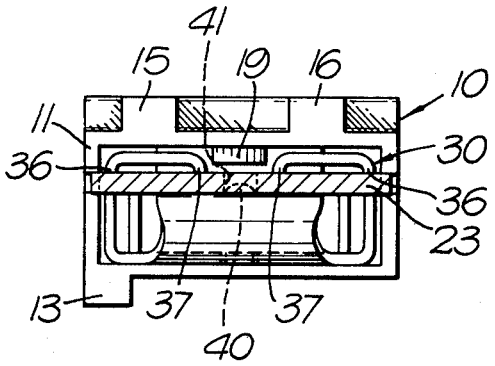
FIG. 2 is a view to an enlarged scale from the other end of a part of the assembly shown in FIG. 1.
Figure 3:
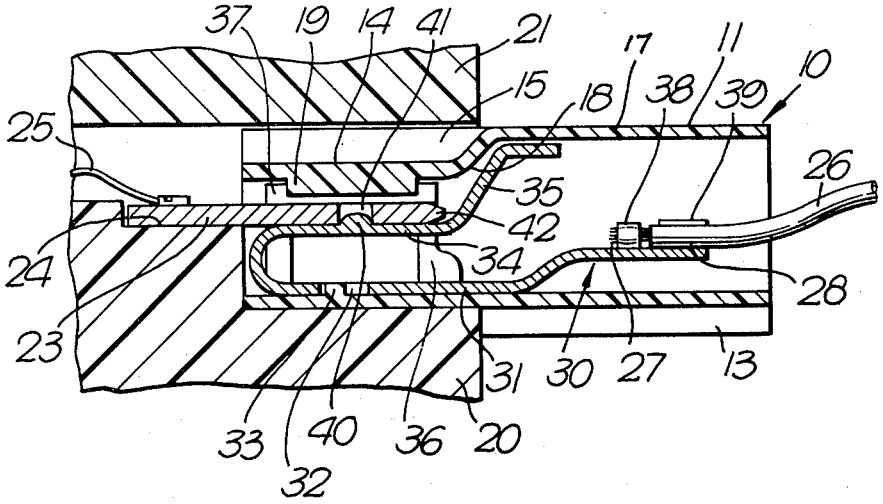
FIGS. 3 and 4 are cross-sectional elevations of the assembly illustrating how the parts of the assembly are separated from one another.

The connector assembly comprises a first part or socket unit 1 provided with a number of sockets 2 to 4 (only three of which are shown), and a plurality of plugs 10 (only one of which is shown) which locate within respective sockets of the first part to thereby form an an electrical connection with the socket unit.

The socket unit 1 is formed from an inner plastics block 20 and an outer plastics sleeve 21 which extends around the block 20 and the probe 22 of a capacitive fuel gauging system. The block 20 and the sleeve 21 are suitably shaped to define the sockets 2 to 4 between them, which may be continuous, as with the sockets 2 and 3, or separate, as with the socket 4. Each socket 2 to 4 includes a metal contact element in the form of an elongate tongue 23 mounted on a ledge 24 within the socket. Electrical connection of each tongue 23 is made by electrical leads 25 which in turn make connection with an outer tube of the probe 22, via a metal stud (not shown) that protrudes through the block 20, and the various other components of the probe.

Each plug 10 comprises a semi-rigid outer plastics housing 11 within which is located an electrical contact element 30. The housing 11 is of generally rectangular shape being provided on its outer surface with a downwardly-projecting rail 13 that extends along the length of the housing at one side. The housing 11 has a forward portion 14 of reduced internal height that is provided, on its outer surface, with two upwardly-projecting rails 15 and 16 that extend rearwardly about half way along the housing. The rails 15 and 16 are both located inset from the sides of the housing 11 by equal distances. The forward portion 14 of the housing 11 is connected with its rear portion 17 via an inclined surface 18 that slopes upwardly from the forward to the rear portions. The housing 11 is open at its front and rear ends to permit entry respectively of the tongue 23 and a cable 26 that is connected with the rear end of the contact element 30. The inner surface of the housing 11 is also provided with a centrally located rail 19 that projects downwardly from the roof of the housing and extends forwardly of the inclined surface 18 to within a short distance of the forward end of the housing.

The contact element 30 in the second part 10 is formed from a unitary strip of brass or other metal, and may be plated, such as, with gold, to improve the contact. The element 30 has a substantially flat forward base portion 31 that is provided with an axial slot 32 that keys with a projection 33 on the bottom of the housing 11 so as to permit limited displacement along the housing but to prevent removal of the element. The element 30 is bent back on itself in a loop at its forward end to produce a centrally-positioned spring portion 34 that is bent upwards at its rear end producing an inclined ramp portion 35. The sides of the element 30 at its forward end are bent upwards and across to form substantially U-shape side portions 36 that extend closely around the walls of the housing. The side portions 36 are also formed with down turned lips 37 that extend along the sides of the centrally-located internal rail 19. The rear part of the element 30 is raised a short distance and is formed with forward and rearward lugs 38 and 39 that are crimped respectively about the conducting wires 27 and the insulation 28 of the cable 26 so as thereby to secure it firmly with the contact element. The cable 26 could also be soldered or welded to the contact element 30 as appropriate.

When the plugs 10 of the connector assembly are mated in the socket 2, 3 or 4, the tongue 23 of each socket projects within the plug between the upper surface of the spring portion 34 and the lips 37. The resilience of the spring portion 34 and the separation between the spring portion and the lips 37, are such that the tongue 23 is clamped firmly between the lips and the spring portion, in good electrical contact with the contact element 30. The upper surface of the spring portion 34 is provided with a projection 40 that engages with a cooperating aperture 41 in the tongue 23 so as to lock the tongue with the contact element 30. The width of the tongue 23 is such that its edges also contact both the side portions 36 which further improves the electrical connection and helps correctly locate the tongue with the contact element. The tip 42 of the tongue 23 is tapered across its width and thickness so as to facilitate insertion in the plug 10.

Figure 4:
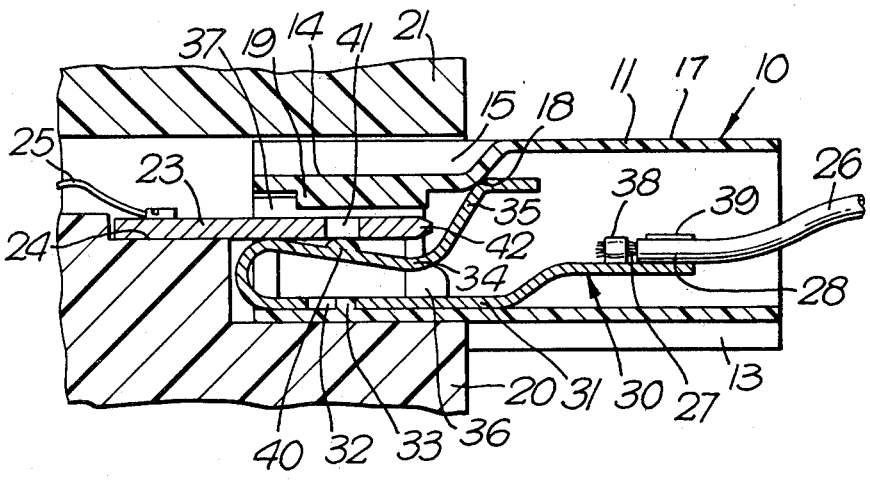

The engagement of the projection 40 in the aperture 41 is sufficiently firm, by virtue of the resilience of the spring portion 34, to prevent the plug 10 being separated from the socket 2 when tension is exerted on the cable 26. The plug 10 can only be separated from the socket 2 by pulling rearwardly on its housing 11. This causes the housing 11 to move rearwardly with respect to the contact element 30, as shown in FIG. 4. The inclined surface 18 of the housing 11 provides an inwardly directed portion that contacts the inclined portion 35 of the contact element 30 thereby forcing the spring portion 34 downwards against its resilience. This enlarges the gap between the spring portion 34 and the lips 37 thereby unlocking the tongue 23 from the projection 40 and allowing the plug 10 to be pulled clear of the socket 2.

The outer surface of the forward part 14 of the housing 11 is especially shaped so that it can only be inserted within the suitably shaped socket 2 in the socket unit 1, thereby ensuring that connection of the cable 26 is made with the correct part of the probe 22. In the arrangement shown, the housing 11 can only be inserted in the left-hand socket 2, the rail 13 projecting in a channel 50 in the block 20, since the downwardly projecting rail 13 will prevent insertion in the right-hand socket 4, while the upwardly projecting rail 16 will prevent insertion in the central socket 3. The rails 13, 15 and 16 thereby act as axially-extending key members that can engage only with cooperating channels or keyways in the first part. The housing 11 of the plug 10, and the sockets 2, 3 and 4 of the first part 1 could be arranged so that each plug will only fit in a respective one of the sockets or so that a socket can receive different ones of the plugs. For example, the connector assembly might have a socket unit with six sockets, and six plugs. Three of the sockets might be so shaped that they will each only receive a particular one of the six plugs. The other three sockets might be shaped so that they will receive any one of the other three plugs. These other three plugs need not necessarily be identically shaped but could differ one from the other so that they could be withdrawn from the socket and inserted in another connector assembly in a unique way. The sockets and plugs may be colored or marked with colored tags to make identification of corresponding sockets and plugs more easy.

The plug and socket connector assembly described above has an advantage of requiring only a push-in fit without relative rotation to lock the two parts together, thereby making secure assembly more easy.

What I claim is:

1. An electrical plug and socket connector assembly for a capacitive fluid-engaging probe comprising: a sleeve which is shaped to extend about the probe, said sleeve having a portion which is remote from said probe, said remote portion of said sleeve having an inner surface which is provided with a configuration of axially extending surface formations; an inner member separate from said sleeve and probe and shaped to be received within said sleeve between said portion of the sleeve and the probe, said inner member having an outer surface which is spaced from said probe and provided with a configuration of axially extending surface formations, the said outer surface of said inner member being disposed in spaced facing relation to the said inner surface of said sleeve to define therebetween a plurality of axially extending socket members which are demarcated from one another by axially extending surface formations on at least one of said inner surface of said sleeve and said outer surface of said inner member, each of said socket members having two opposing sides which are defined respectively by a part of said inner surface of said sleeve and by a part of said outer surface of said inner member, the surface configurations of said opposing sides of each said socket member being defined by said axially extending surface formations on said parts, the said surface configurations of the opposing sides of at least some of said socket members differing from one another; a plurality of first contact elements; means mounting one each of said first contact elements in respective different ones of said socket members; a plurality of separate plug members each of which is adapted to be individually inserted into one of said socket members independently of the insertion of any other of said plug members into any other of said socket members, each said plug member having an outer housing containing a single second contact element that is positioned to engage the one of said first contact elements in the socket member into which said plug member is inserted, the housing of each of said plug members having a pair of opposing sides adapted to be disposed in facing slideable relation to the said opposing sides of the socket member into which said plug member is inserted, the said opposing sides of each said plug member housing having configurations of axially extending surface formations respectively shaped for cooperation with the surface configurations in the said opposing sides of the said socket member into which said plug member is slideably inserted, the said surface configurations of the opposing sides of the housing of at least one of said plug members differing from the said surface configurations of the opposing sides of at least one of said socket members such that said at least one of said plug members is prevented from being inserted into said at least one of said socket members.

2. An electrical connector assembly according to claim 1, wherein said axially extending surface formations are rails and channels.

3. An electrical connector assembly according to claim 1 wherein said first and second contact elements have cooperating locking means, each said second contact element being mounted in the housing of its associated plug member for limited displacement along said housing, said housing having an inwardly directed surface formation that engages said second contact element on movement of said housing away from its respective socket member so as to disengage said locking means thereby to permit withdrawal of said plug member from its associated socket member.

4. An electrical connector assembly according to claim 1, wherein said plug members have said axially extending surface formations at their forward ends only.

5. An electrical connector assembly according to claim 1 wherein each said second contact element has a slot formed therein, the housing of said plug member having a projection that extends within said slot and thereby limits displacement of said second contact element along said housing.

6. An electrical connector assembly according to claim 1, wherein each said second contact element is formed in a resilient loop.

7. An electrical connector assembly according to claim 3, wherein said locking means is provided by a projection on one of said contact elements that engages with a recess in the other of said contact elements.

8. An electrical connector assembly according to claim 3, wherein said inwardly directed surface formation is provided by an inclined surface on the inner surface of the housing of said plug member.

9. An electrical connector assembly according to claim 1 wherein said first contact elements are mounted on said inner member.

* * * * *